US009928782B2

(12) United States Patent
Do et al.

(10) Patent No.: US 9,928,782 B2
(45) Date of Patent: Mar. 27, 2018

(54) FOUR-PRIMARY-COLOR ORGANIC LIGHT EMITTING DISPLAY AND DRIVING METHOD THEREOF

(71) Applicant: LG Display Co., Ltd., Seoul (KR)

(72) Inventors: Osung Do, Paju-si (KR); Kyoungdon Woo, Paju-si (KR); Seokhyun Hong, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 87 days.

(21) Appl. No.: 15/140,094

(22) Filed: Apr. 27, 2016

(65) Prior Publication Data

US 2016/0322001 A1 Nov. 3, 2016

(30) Foreign Application Priority Data

Apr. 29, 2015 (KR) ..... 10-2015-0060645

(51) Int. Cl.
*G09G 3/3291* (2016.01)
*G09G 3/20* (2006.01)

(52) U.S. Cl.
CPC ..... *G09G 3/3291* (2013.01); *G09G 3/2007* (2013.01); *G09G 2300/0452* (2013.01); *G09G 2310/027* (2013.01); *G09G 2310/08* (2013.01); *G09G 2320/10* (2013.01)

(58) Field of Classification Search
CPC .. G09G 3/3291; G09G 3/2007; G09G 3/3233; G09G 3/3655; G09G 3/3225; G09G 2300/0452; G09G 2310/027; G09G 2310/08; G09G 2320/10
See application file for complete search history.

(56) References Cited

U.S. PATENT DOCUMENTS

2004/0222999 A1 11/2004 Choi et al.
2005/0140597 A1 6/2005 Lee et al.
2007/0242006 A1 10/2007 Lin
(Continued)

FOREIGN PATENT DOCUMENTS

EP 1087365 A2 3/2001
EP 1087444 A2 3/2001
(Continued)

OTHER PUBLICATIONS

European Partial Search Report, European Application No. 16167210.0, dated Jul. 5, 2016, 9 pages.
(Continued)

*Primary Examiner* — Richard Hong
(74) *Attorney, Agent, or Firm* — Fenwick & West LLP

(57) ABSTRACT

A four-primary-color organic light emitting display comprises: a display panel where a plurality of first-color pixels, second-color pixels, third-color pixels, and fourth-color pixels are disposed; and a data drive circuit that has a single, digital-to-analog converter to generate first- to fourth-color data voltages and to apply the first-color data voltage to the first-color pixels, the second-color data voltage to the second-color pixels, the third-color data voltage to the third-color pixels, and the fourth-color data voltage to the fourth-color pixels. Herein, the maximum grayscale voltages for the first- to fourth-color data voltages are adjusted to be different on a single gamma graph defined as the input grayscale versus output voltage.

14 Claims, 12 Drawing Sheets

(56) References Cited

U.S. PATENT DOCUMENTS

| | | | | |
|---|---|---|---|---|
| 2009/0189924 | A1* | 7/2009 | Ogura | G09G 3/3233 345/690 |
| 2011/0227891 | A1* | 9/2011 | Lee | G09G 3/3655 345/211 |
| 2013/0155043 | A1 | 6/2013 | Woo et al. | |
| 2013/0249969 | A1 | 9/2013 | Jeon et al. | |
| 2013/0300773 | A1 | 11/2013 | Kim | |

FOREIGN PATENT DOCUMENTS

| | | | |
|---|---|---|---|
| KR | 10-2011-0038496 | A | 4/2011 |
| KR | 10-2013-0060476 | A | 6/2013 |
| KR | 10-2014-0059386 | A | 5/2014 |

OTHER PUBLICATIONS

European Examination Report, European Application No. 16167210.0, dated Sep. 20, 2017, 13 pages.

* cited by examiner

FOUR-PRIMARY-COLOR ORGANIC LIGHT EMITTING DISPLAY AND DRIVING METHOD THEREOF

CROSS-REFERENCE TO RELATED APPLICATION

This application claims the priority benefit of Korean Patent Application No. 10-2015-0060645 filed on Apr. 29, 2015, which is hereby incorporated herein by reference for all purposes as if fully set forth herein.

BACKGROUND

Field of the Invention

The present invention relates to a four-primary-color organic light emitting display and a driving method thereof.

Discussion of the Related Art

Flat panel displays (FPD) are used in various electronic products, including cell phones, tablet PCs, laptops, etc.

An organic light emitting display, which is a type of flat panel display, is a self-luminous device that causes an organic light emitting layer to emit light via the recombination of electrons and holes. The organic light emitting display is regarded as the next-generation display owing to its high luminance, low operating voltage, and ultra-thin profile. Each individual pixel of the organic light emitting display comprises an organic light emitting diode (hereinafter, OLED), which is a light emitting element consisting of an anode and a cathode and an organic light emitting layer formed between the cathode and anode, and a pixel circuit for independently driving the OLED. The pixel circuit mainly comprises a switching thin film transistor (hereinafter, switching TFT), a storage capacitor, and a driving element (driving TFT). The switching TFT charges the capacitor with a data voltage in response to a scan signal, and the driving TFT adjusts the amount of light emitted by the OLED by controlling the amount of current supplied to the OLED based on the amount of voltage stored in the capacitor. The amount of light emitted by the OLED is proportional to the current supplied from the driving TFT.

An OLED generally displays various colors by mixing three primary colors, including R (red), G (green), and B (blue). Recently, OLEDs display four primary colors including R (red), G (green), B (blue), and W (white).

A four-primary-color organic light emitting display comprises pixels comprising R OLEDs that emit R, pixels comprising G OLEDs that emit G, pixels comprising B OLEDs that emit B, and pixels comprising W OLEDs that emit W. The R OLED, G OLED, B OLED, and W OLED differ in their physical properties such as luminous efficiency. Luminous efficiency is defined as the ratio of the amount of light emission to driving current. Accordingly, if the data voltage applied to the pixels is controlled for each color, it becomes easier to correct white color coordinates. To this end, the four-primary-color display converts input digital video data into an analog data voltage by using four digital-to-analog converters (hereinafter, DAC) corresponding to the four colors.

That is, for the four-primary color organic light emitting display, the data voltage Vdata for each gray level depending on the OLED characteristics varies with color, as shown in FIG. 1. Also, as shown in FIG. 2, assuming that the maximum grayscale value is 255, the maximum grayscale voltage for driving an OLED varies with color.

In such an individual gamma-type four-primary-color organic light emitting display, it is necessary for a data drive circuit to incorporate four DACs corresponding to the respective colors. This increases the chip size and manufacturing costs of integrated circuits.

SUMMARY

Accordingly, the present invention is directed to a four-primary-color organic light emitting display which can reduce the chip size and manufacturing costs of a data drive circuit and minimize distortion of white color coordinates by using a common gamma method, and a driving method thereof.

An exemplary embodiment of the present invention provides a four-primary-color organic light emitting display comprising: a display panel where a plurality of first-color pixels, second-color pixels, third-color pixels, and fourth-color pixels are disposed; and a data drive circuit that has a single, digital-to-analog converter to generate first- to fourth-color data voltages and to apply the first-color data voltage to the first-color pixels, the second-color data voltage to the second-color pixels, the third-color data voltage to the third-color pixels, and the fourth-color data voltage to the fourth-color pixels, wherein the maximum grayscale voltages for the first- to fourth-color data voltages are adjusted to respective modulated maximum grayscale voltages corresponding to a single gamma graph defined as the input grayscale versus output voltage and at least one of the modulated maximum grayscale voltages is different from another one of the modulated maximum grayscale voltages.

A second exemplary embodiment of the present invention provides a driving method of a four-primary-color organic light emitting display with a display panel where a plurality of first-color pixels, second-color pixels, third-color pixels, and fourth-color pixels are disposed, the method comprising: generating first- to fourth-color data voltages by a single, digital-to-analog converter; and applying the first-color data voltage to the first-color pixels, the second-color data voltage to the second-color pixels, the third-color data voltage to the third-color pixels, and the fourth-color data voltage to the fourth-color pixels, wherein the maximum grayscale voltages for the first- to fourth-color data voltages are adjusted to respective modulated maximum grayscale voltages corresponding to a single gamma graph defined as the input grayscale versus output voltage and at least one of the modulated maximum grayscale voltages is different from another one of the modulated maximum grayscale voltages.

A third exemplary embodiment of the present invention provides an organic light emitting display comprising a display panel comprising pixels of a plurality of colors including at least a first color pixel and a second color pixel; and a data modulator that converts first-color digital video data and second-color digital video data for display on the first color pixel and the second color pixel, respectively, to modulated first-color video data and modulated second-color video data, respectively, the modulated first-color video data not exceeding a first-color maximum grayscale value and the modulated second-color video data not exceeding a second-color maximum grayscale value, the second-color maximum grayscale being smaller than the first-color maximum grayscale value.

A fourth exemplary embodiment of the present invention provides a driving method of an organic light emitting display with a display panel where a plurality of colored pixels including at least a first color pixel and a second color pixel are disposed, the method comprising: converting, by a data modulator, first-color digital video data and second-color digital video data for display on the first color pixel and the second color pixel, respectively, to modulated first-color video data and modulated second-color video data, respectively, the modulated first-color video data not exceeding a first-color maximum grayscale value and the modulated second-color video data not exceeding a second-color maximum grayscale value, the second-color maximum grayscale being smaller than the first-color maximum grayscale value.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Hereinafter, an exemplary embodiment of the present invention will be described with reference to FIGS. 3 through 13B.

Figure 1:
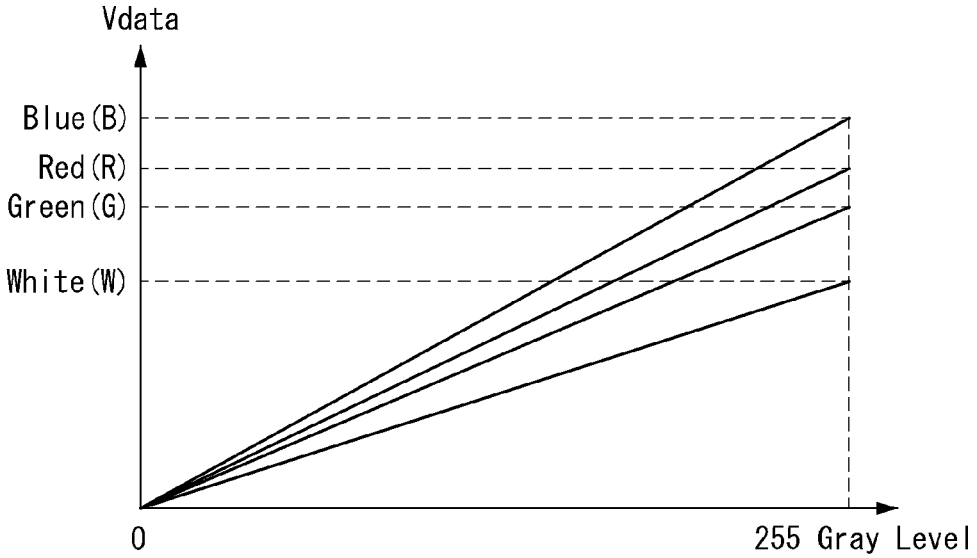
FIG. 1 (RELATED ART)
FIG. 1 is a view illustrating the data voltage variation with color for each gray level, in a conventional individual-gamma type four-primary-color organic light emitting display.
Figure 2:
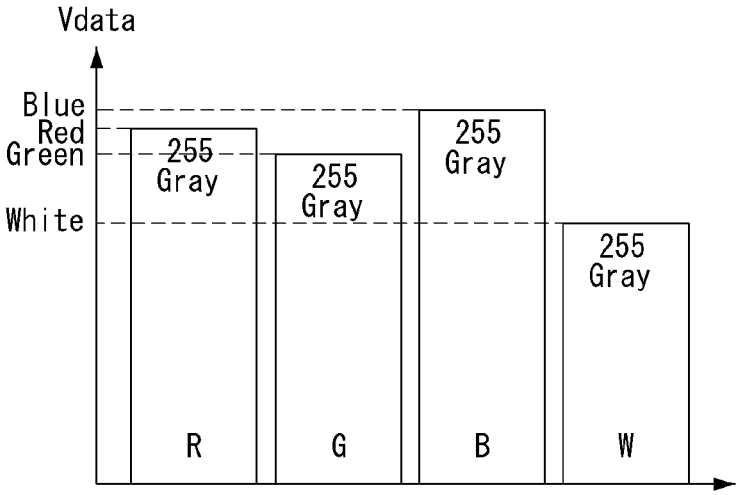
FIG. 2 (RELATED ART)
FIG. 2 is a view illustrating the variation with color of the maximum grayscale voltage for driving an OLED, in the conventional individual-gamma type four-primary-color organic light emitting display.
Figure 3:
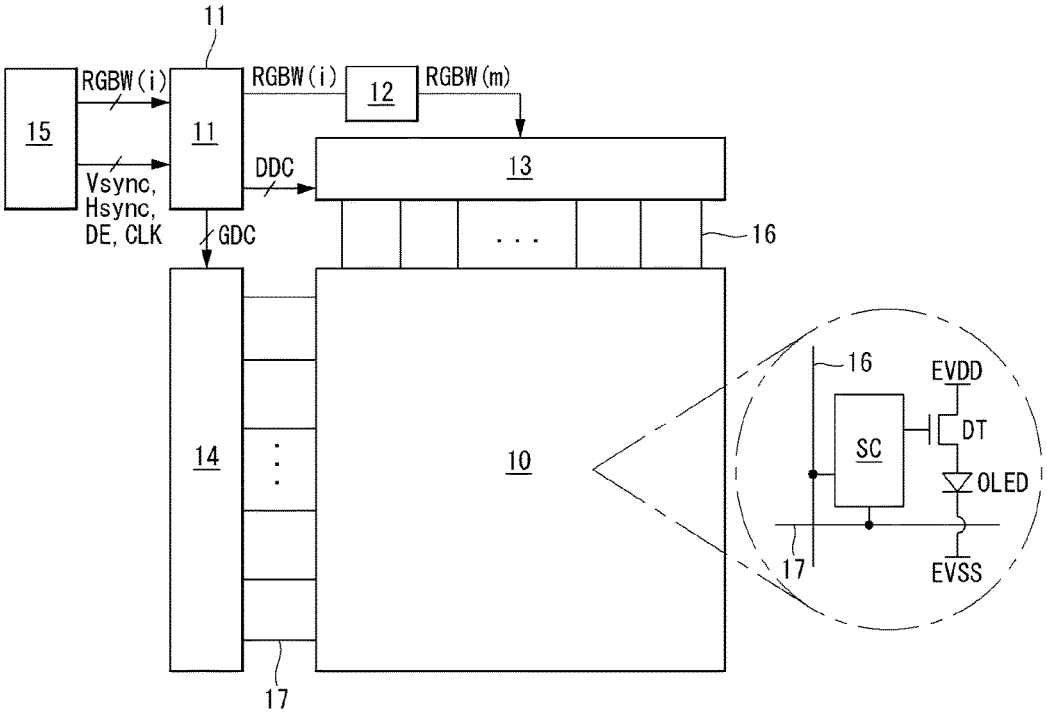
FIG. 3 is a block diagram illustrating a four-primary-color organic light emitting display according to the present invention.

FIG. 3 is a block diagram illustrating a four-primary-color organic light emitting display according to the present invention.

Referring to FIG. 3, the four-primary-color organic light emitting display device according to the present invention comprises a display panel 10, a timing controller 11, a data modulator 12, a data drive circuit 13, a gate drive circuit 14, and a host system 15.

A plurality of data lines 16 and a plurality of gate lines 17 crossing each other are provided on the display panel 10, and pixels are arranged in a matrix at the crossings of the data lines 16 and the gate lines 17. Each pixel comprises an OLED, a driving TFT (DT) that controls the amount of current flowing through the OLED, and a programming part SC for setting the gate-source voltage of the driving TFT (DT). The programming part SC may comprise at least one switching TFT (not shown) and a storage capacitor (not shown). The switching TFT turns on in response to a scan signal from a gate line 17 to thereby apply a data voltage from a data line 16 to one electrode of the storage capacitor. The driving TFT DT adjusts the amount of light emitted by the OLED by controlling the amount of current supplied to the OLED based on the amount of voltage stored in the storage capacitor. The amount of light emitted by the OLED is proportional to the current supplied from the driving TFT DT. Such a pixel takes high-voltage power EVDD and low-voltage power EVSS from a power generator (not shown). The TFTs of the pixel may be implemented as p-type or n-type. Also, a semiconductor layer for the TFTs of the pixel may comprise amorphous silicon, or polysilicon, or oxide.

To produce four-primary colors, the pixels comprise first color pixels comprising first-color OLEDs to display a first color, second color pixels comprising second-color OLEDs to display a second color, third color pixels comprising third-color OLEDs to display a third color, and four color pixels comprising fourth-color OLEDs to display a fourth color. Here, the first to fourth colors may be different colors of R, G, B, and W.

The timing controller 11 receives four-primary color digital video data RGBW(i) of an input image from the host system 15 via an interface circuit (not shown), and supplies this four-primary-color digital video data RGBW(i) to the data modulator 12.

The timing controller 11 receives timing signals such as a vertical synchronization signal Vsync, a horizontal synchronization signal Hsync, a data enable signal DE, and a dot clock CLK from the host system 15, and generates control signals for controlling the timings of operation of the data drive circuit 13 and gate drive circuit 14. The control signals comprise a gate timing control signal GDC for controlling the timing of operation of the gate drive circuit 14 and a source timing control signal DDC for controlling the timing of operation of the data drive circuit 13.

The data modulator 12 receives the same number of (i.e., m) bits of first-, second-, third-, and fourth-color digital video data RGBW(i) (m is a natural number) from the timing controller 11, which is to be displayed in each of the first- to fourth-color pixels, and modulates the first- to fourth-color digital video data based on the maximum grayscale values of the first- to fourth-color digital video data RGBW(i) individually determined based on luminous efficiency. A detailed description of the data modulator 12 will be given with reference to FIGS. 6 through 8.

Figure 6:
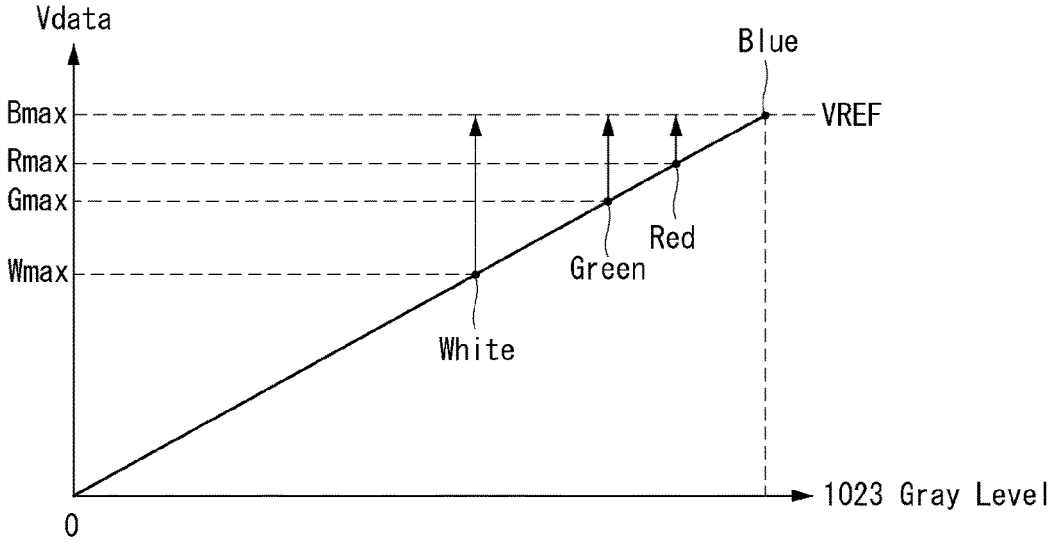
FIG. 6 illustrates an operating principle for minimization of chromaticity coordinate distortion in the common gamma method.

The operation of the data drive circuit 13 is controlled in response to the source timing control signal DDC. The data drive circuit 13 receives the first- to fourth-color digital video data modulated by the data modulator 12. The data drive circuit 13 has a single DAC to generate first- to fourth-color data voltages corresponding to the first- to fourth-color modulated digital video data RGBW(m) and to supply the first- to fourth-color data voltages to the data lines 16. The first-color data voltage is applied to the first-color pixels, the second-color data voltage is applied to the second-color pixels, the third color data voltage is applied to the third-color pixels, and the fourth color data voltage is applied to the fourth-color pixels. Accordingly, the maximum grayscale voltages for the first- to fourth-color data voltages are adjusted to be different depending on the luminous efficiency of the four-primary-color pixels, on a single gamma graph defined as the input grayscale versus output voltage. For example, as shown in FIG. 6, for a display panel with the order of highest to lowest luminous efficiency: W pixels>G pixels>R pixels>B pixels, the maximum grayscale voltages may be adjusted to correspond to this order: B data voltage (B max)>R data voltage (R max)>G data voltage (G max)>W data voltage (W max). As a result, distortion of white color coordinates may be minimized, even if the common gamma method is applied to reduce the chip size and manufacturing costs of the data drive circuit.

The gate drive circuit 14 generates a scan signal in response to a gate timing control signal GDC from the timing controller 11, and supplies this scan signal to the gate lines 17 according to a line-sequential system.

Figure 4:
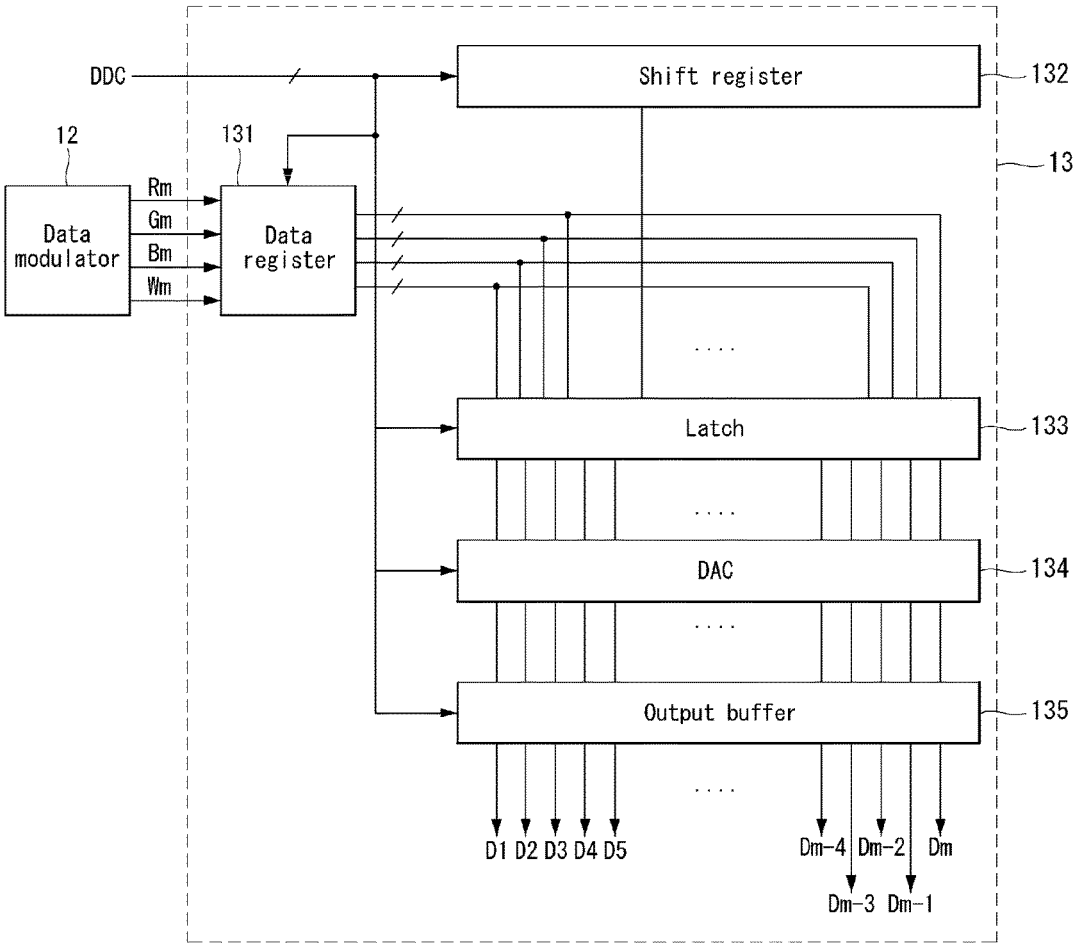
FIG. 4 is a block diagram illustrating the internal configuration of the data drive circuit of FIG. 3.
Figure 5:
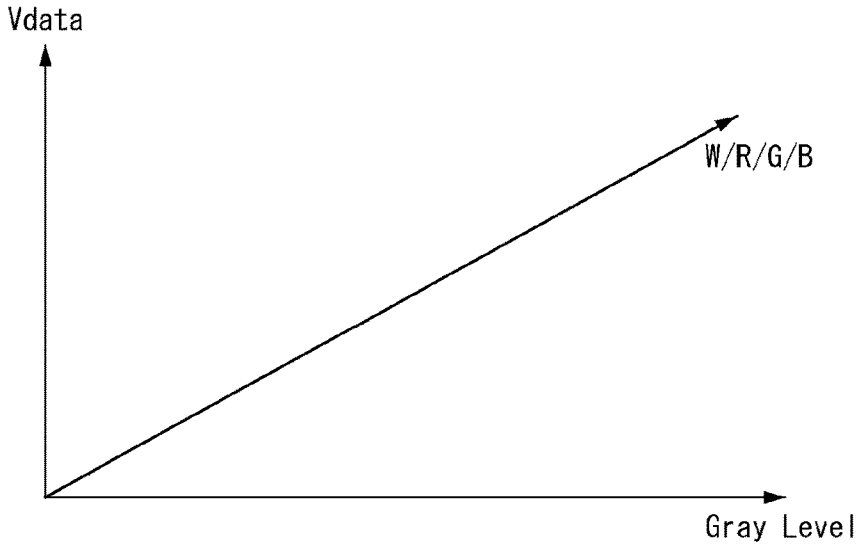
FIG. 5 illustrates a grayscale representation principle according to a common gamma method.

FIG. 4 is a block diagram illustrating the internal configuration of the data drive circuit 13 of FIG. 3. FIG. 5 illustrates a grayscale representation principle according to a common gamma method.

Referring to FIG. 4, the data drive circuit 13 comprises a data register 131, a shift register 132, a latch 133, a DAC 134, and an output buffer 135.

The data register 131 temporarily stores first- to fourth-color modulated digital video data RGBW(m) input from the data modulator 12, in response to a source timing control signal DDC.

The shift register 132 shifts a sampling signal in response to the source timing control signal DDC.

The latch 133 samples the first- to fourth-color modulated digital video data RGBW(m) from the data register 131 in response to sampling signals sequentially input from the shift register 132, latches the data RGBW(m) for each horizontal line, and simultaneously outputs the data RGBW(m) for each horizontal line.

The DAC 134 maps the data RGBW(m) for each horizontal line input from the latch 133 to predetermined gamma voltages and generates first- to fourth-color data voltages. The DAC 134 is not provided for each color but used in common for the four primary colors. That is, since the DAC 134 is implemented according to the common gamma method as shown in FIG. 5, the first- to fourth-color data voltages output from the DAC 134 are equal if the first- to fourth-color modulated digital video data RGBW(m) input into the DAC 134 has the same grayscale value. A detailed description of the DAC 134 will be given with reference to FIGS. 9 through 11B.

The output buffer 135 comprises a plurality of buffers connected one-to-one to output channels D1 to Dm to minimize signal attenuation of the first- to fourth-color data voltages supplied from the DAC 134.

Figure 7:
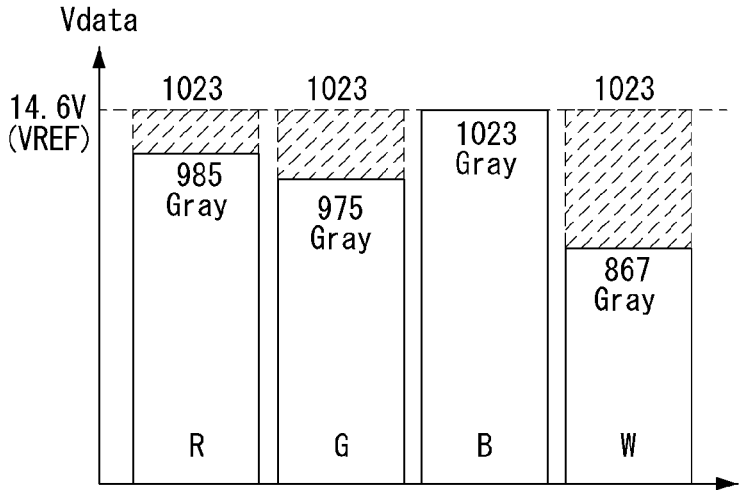
FIGS. 7 and 8 illustrate examples of common grayscale representation using the operating principle of FIG. 6.
Figure 8:
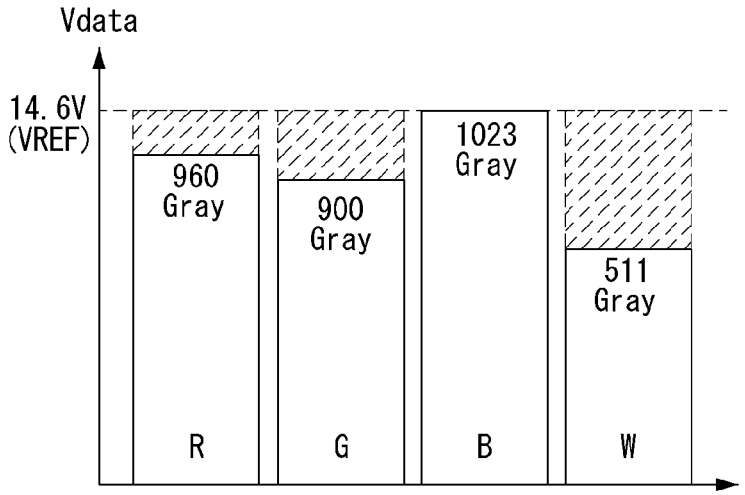

FIG. 6 illustrates an operating principle for minimization of chromaticity coordinate distortion in the common gamma method. FIGS. 7 and 8 illustrate examples of common grayscale representation using the operating principle of FIG. 6.

The data modulator 12 sets the maximum grayscale values of first- to fourth-color digital video data RGBW(i) individually based on luminous efficiency so that the maximum grayscale voltages for the first- to fourth-color data voltages can differ depending on the luminous efficiency of the four-primary-color pixels, and modulates the first- to fourth-color digital video data based on the maximum grayscale values.

The data modulator 12 sets the maximum grayscale values of the first- to fourth-color digital video data in a range that satisfies white color coordinates. Here, pixels with the lowest luminous efficiency are set to have the highest maximum grayscale value, and pixels with the highest luminous efficiency are set to have the lowest maximum grayscale value. For example, as shown in FIG. 7, for a display panel with the order of highest to lowest luminous efficiency: W pixels>G pixels>R pixels>B pixels, B data has the highest maximum grayscale value '1023', R data has the second highest maximum grayscale value '985', G data has the third highest maximum grayscale value '975', and W data has the lowest maximum grayscale value '867'.

With the first-color pixels having the lowest luminous efficiency and the fourth-color pixels having the highest luminous efficiency, the data modulator 12 sets the maximum grayscale value of the first color at a reference value of $2^m-1$ and bypasses first-color digital video data upon receipt. Then, the data modulator 12 sets the maximum second- and third-color grayscale values to be smaller than the reference value and the maximum fourth-color grayscale value to be smaller than the maximum second- and third-color grayscale values, and then modulates second-color digital video data to not exceed the maximum second-color grayscale value, third-color digital video data to not exceed the maximum third-color grayscale value, and fourth-color digital video data to not exceed the maximum fourth-color grayscale value.

For example, as shown in FIG. 7, for a display panel with the order of highest to lowest luminous efficiency: W pixels>G pixels>R pixels>B pixels, the data modulator 12 may set the maximum B grayscale value at a reference value '1023' of $2^{10}-1$, the maximum R grayscale value at '985', the maximum G grayscale value at '975', and the maximum W grayscale value at '867'. Then, the data modulator 12 may bypass B data upon receipt, and replace R data by the maximum R grayscale value if it exceeds the maximum R grayscale value '985', G data by the maximum G grayscale value if it exceeds the maximum G grayscale value '975', and W data by the maximum W grayscale value if it exceeds the maximum W grayscale value '867'. In this case, the data modulator 12 may bypass R data upon receipt if it is equal to or smaller than the maximum R grayscale value '985', G data upon receipt if it is equal to or smaller than the maximum G grayscale value '975', and W data upon receipt if it is equal to or smaller than the maximum W grayscale value '867'. In other words, the data modulator 12 may clamp the modulated gray scale values for B, R, G, W at the set maximum B, R, G, W grayscale values, respectively, if the received B, R, G, W gray scale values exceed the set maximum B, R, G, W grayscale values, respectively. On the other hand, the data modulator 12 may bypass the modulated gray scale values for B, R, G, W as they are, if the received B, R, G, W gray scale values do not exceed the set maximum B, R, G, W grayscale values, respectively.

With the first-color pixels having the lowest luminous efficiency and the fourth-color pixels having the highest luminous efficiency, the data modulator 12 may maintain the number of bits of the first- to third-color digital video data at m and modulate the number of bits of the fourth-color digital video data to be smaller than m, in order to make it easier to set the maximum first- to fourth-color grayscale values.

For example, as shown in FIG. 8, for a display panel with the order of highest to lowest luminous efficiency: W pixels>G pixels>R pixels>B pixels, the data modulator 12 may maintain the number of bits of B, R, and G data at 10 and modulate the number of bits of W data to be 9. By this, the data modulator 12 may set the maximum B grayscale value at a reference value ('1023') of $2^{10}-1$, the maximum R grayscale value at '960', the maximum G grayscale value at '900', and the maximum W grayscale value at '511'.

Figure 9:
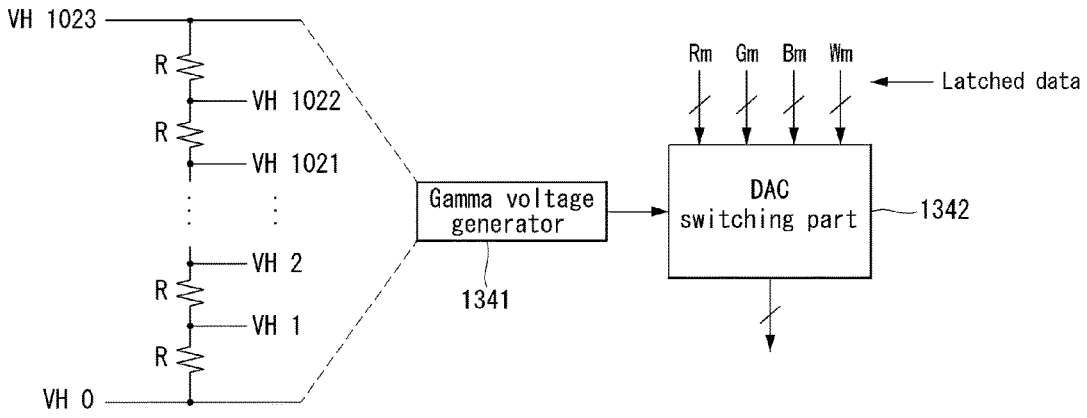
FIG. 9 schematically illustrates the configuration of the DAC of FIG. 4.

FIGS. 7 and 8 are merely examples of the present invention, and the order of colors with the highest to lowest luminous efficiency and the maximum grayscale value for each color may vary freely depending on the model, specification, etc. of the display panel. In addition, although the embodiments of FIGS. 7 and 8 were illustrated with an OLED display that has four-primary-color pixels, the present invention can be used with an OLED display or any other type of display device in which any two or more colors of sub-pixels with different luminous efficiency are used in the pixels to display images. For example, the present invention may be used with three-primary-color OLED devices that use R, G, B subpixels in each pixel to display images. FIG. 9 schematically illustrates the configuration of the DAC of FIG. 4. FIGS. 10A through 11B illustrate in detail the configuration of the DAC of FIG. 4.

Referring to FIG. 9, the single DAC 134 comprises a gamma voltage generator 1341 and a DAC switching part 1342.

The gamma voltage generator 1341 divides an operating voltage (VDD of FIGS. 10A through 11B) to generate a predetermined number of gamma voltages VH0 to VH1023. The gamma voltage generator 1341 may be implemented as a resistor (R) string (see FIGS. 10A and 10B) or capacitor (C) string (see FIGS. 11A and 11B) that divides the operating voltage. The resistor (R) string or capacitor (C) string is employed in the DAC to easily divide the operating voltage.

The DAC switching part 1342 maps latched first- to fourth-color modulated digital video data RmGmBmWm to the gamma voltages VH0 to VH1023 input from the gamma voltage generator 1341 to generate the first- to fourth-color data voltages.

The DAC switching part 1342 may be implemented as CMOS switches that cover the entire grayscale range; more preferably, PMOS switches that cover part of the entire grayscale range and NMOS switches that cover the other part, in order to reduce the DAC size.

Figure 10A:
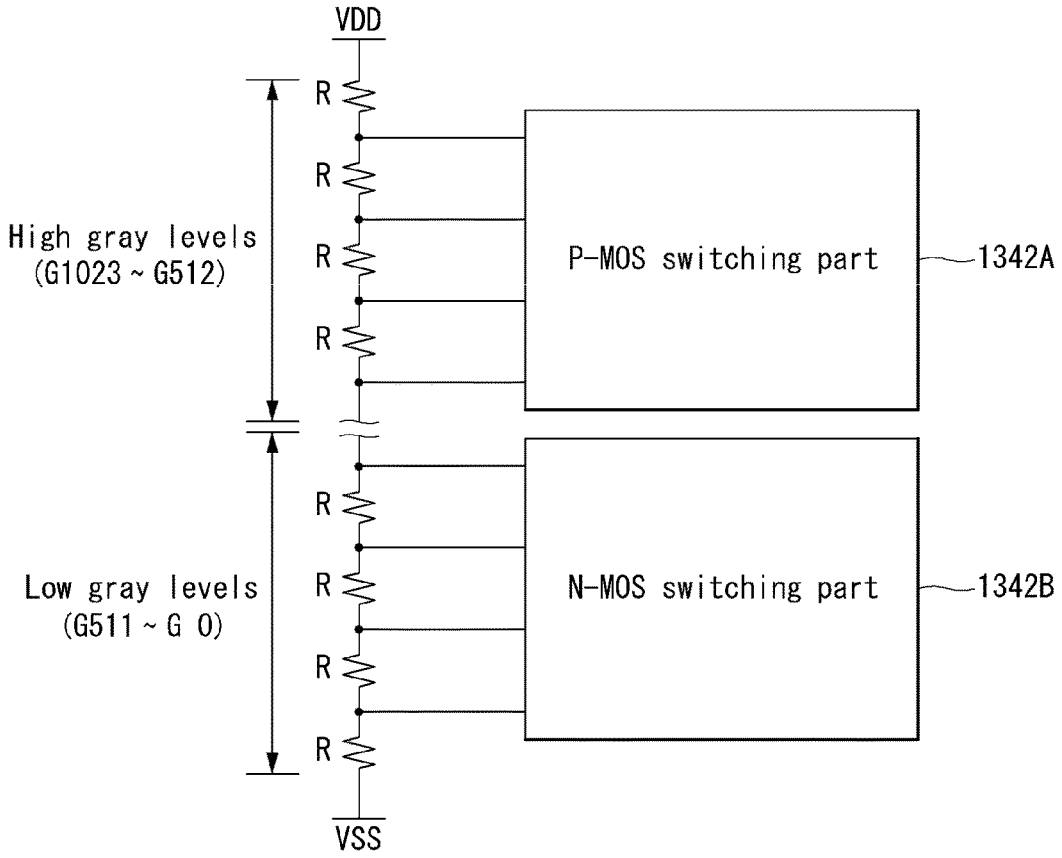
FIGS. 10A, 10B, 11A, and 11B illustrate in detail the configuration of the DAC of FIG. 4.
Figure 11A:
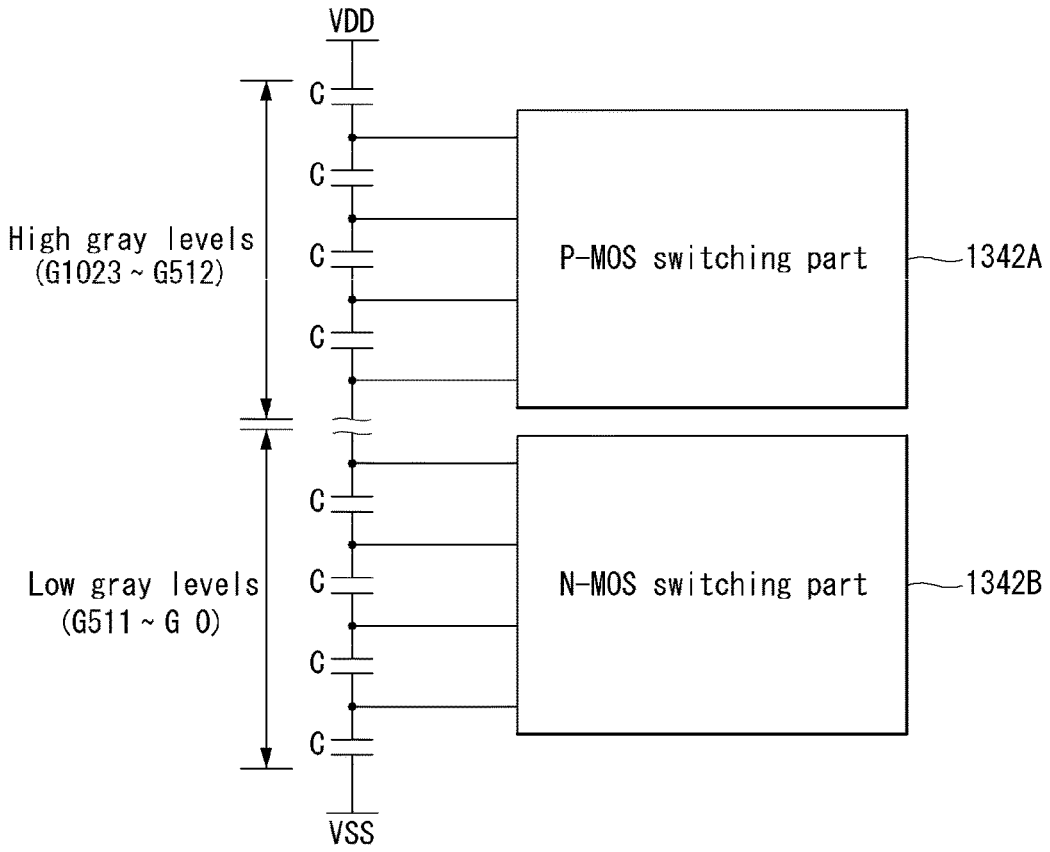

In an example, as shown in FIGS. 10A and 11A, the DAC switching part 1342 may comprise a PMOS switching part 1342A comprising a plurality of PMOS switches connected to a high grayscale output section of the gamma voltage generator 1341, and an NMOS switching part 1342B comprising a plurality of NMOS switches connected to a low grayscale output section of the gamma voltage generator 1341.

Figure 10B:
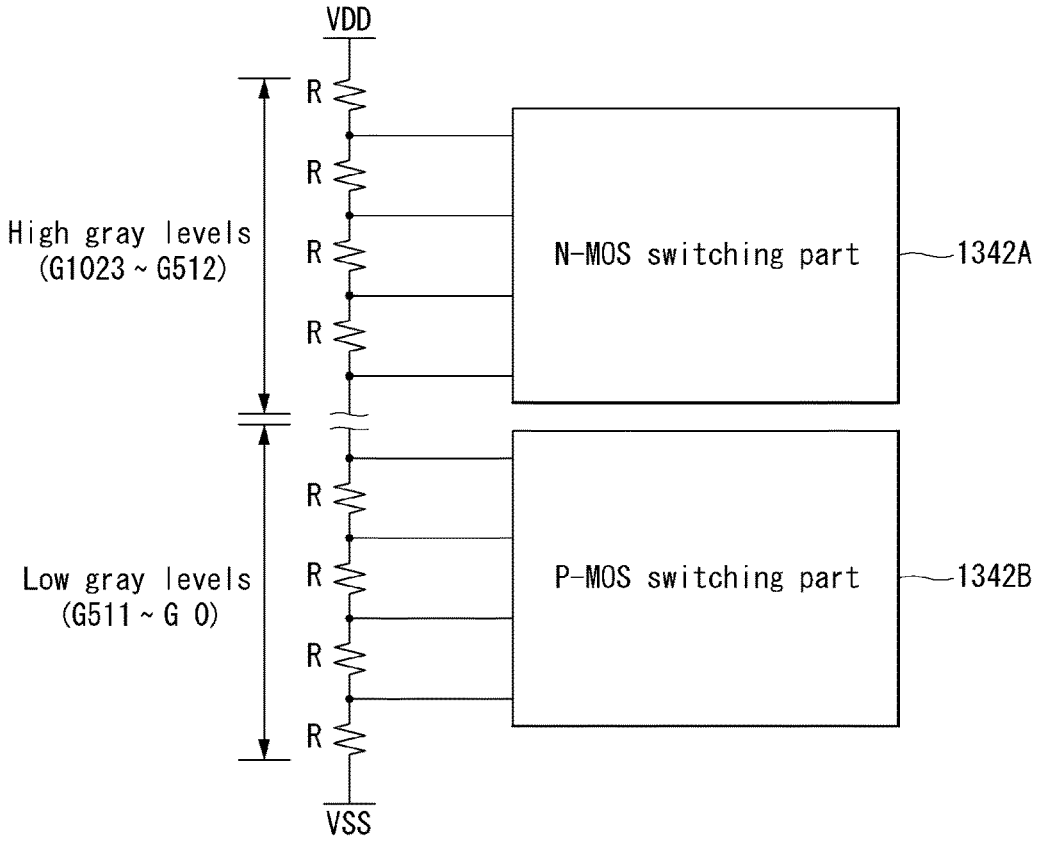
Figure 11B:
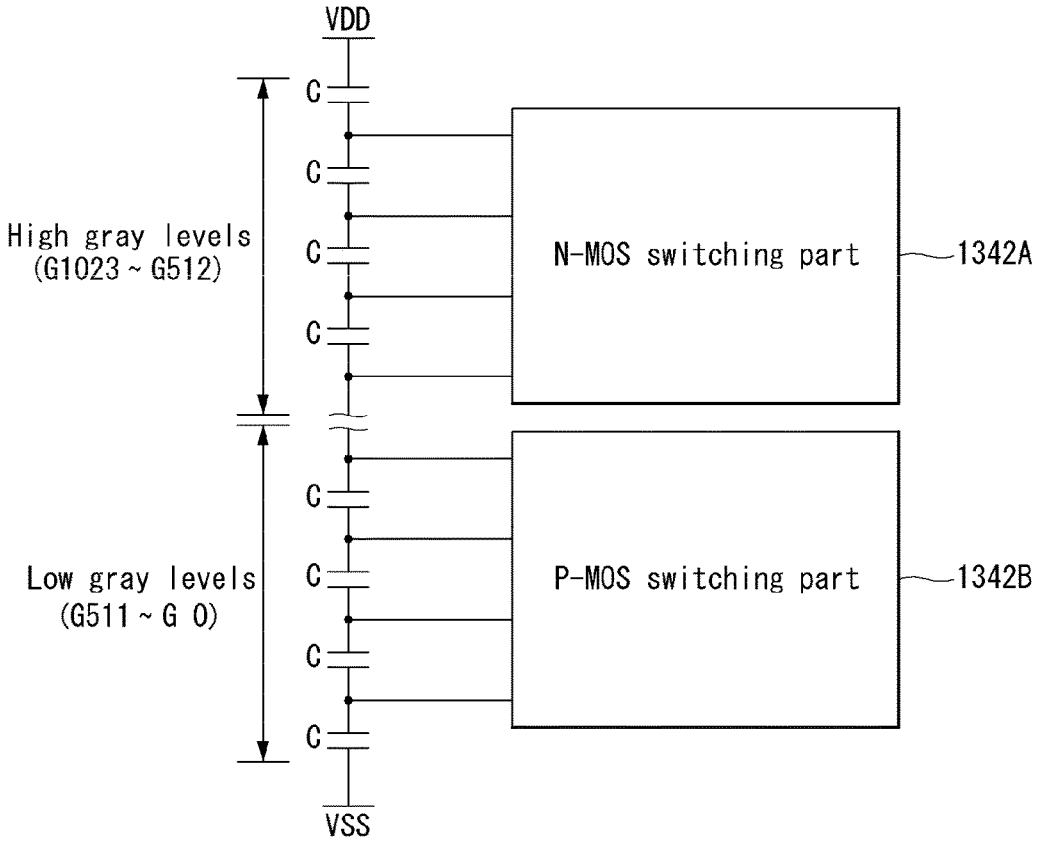

In another example, as shown in FIGS. 10B and 11B, the DAC switching part 1342 may comprise an NMOS switching part 1342A comprising a plurality of NMOS switches connected to a high grayscale output section of the gamma voltage generator 1341, and a PMOS switching part 1342B comprising a plurality of PMOS switches connected to a low grayscale output section of the gamma voltage generator 1341.

Figure 12:
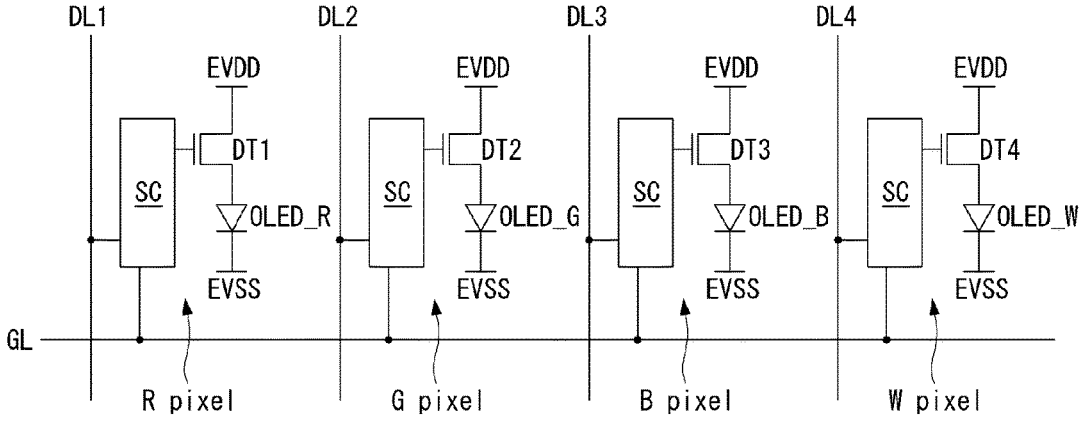
FIG. 12 illustrates one connection configuration of R, G, B, and W pixels.

FIG. 12 illustrates one connection configuration of R, G, B, and W pixels.

As shown in FIGS. 7 and 8, a grayscale loss occurs to digital data that is modulated based on maximum grayscale values smaller than a reference value. That is, upon receiving data with a grayscale value higher than the maximum grayscale value, the grayscale of the data is replaced by the maximum grayscale value.

To minimize color distortion caused by such a grayscale loss, the driving TFT included in each of the first- to fourth-color pixels may be designed to vary in current driving capability. That is, as shown in FIG. 12, for a display panel with the order of highest to lowest luminous efficiency: W pixels>G pixels>R pixels>B pixels, the driving TFT's current driving capability may be in the order: DT3 of B pixels>DT1 of R pixels>DT2 of G pixels>DT4 of W pixels. Here, the driving TFT's current driving capability is dependent on various physical factors for determining the amount of current flowing between the drain and source of the driving TFT.

Figure 13A:
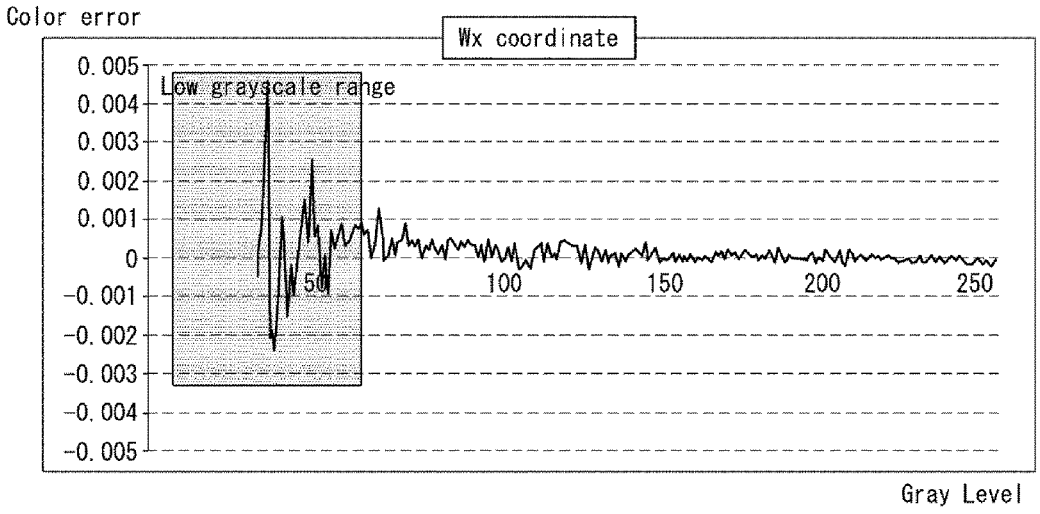
FIGS. 13A and 13B illustrate the results of analysis of white color coordinates according to the common gamma method of the present invention.
Figure 13B:
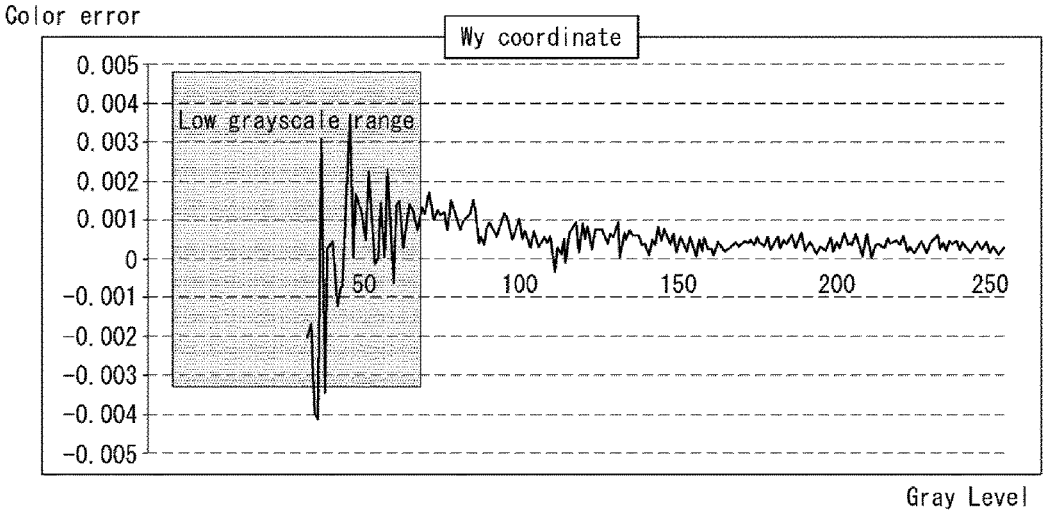

FIGS. 13A and 13B illustrate the results of analysis of white color coordinates according to the common gamma method of the present invention.

An R OLED, a G OLED, a B OLED, and W OLED differ in their physical properties such as luminous efficiency. Accordingly, if the data voltage applied to the pixels is individually controlled for each color by using four DACs, it becomes easier to match white color coordinates. However, as stated above, in such an individual gamma-type four-primary-color organic light emitting display, it is necessary for a data drive circuit to incorporate four DACs corresponding to the respective colors. This increases the chip size and manufacturing costs of integrated circuits.

In this regard, the present invention may minimize distortion of white color coordinates, which is a problem in the common gamma method, as described above, by reducing the chip size and manufacturing costs of the data drive circuit according to the common gamma method and adjusting the maximum grayscale voltages for first- to fourth-color data voltages differently depending on the luminous efficiency for each color.

As a result of analysis of the white color coordinates according to the present invention, the achieved white X coordinate is shown in FIG. 13A and the white Y coordinate is shown in FIG. 13B. The test result shows that there was no substantial difference with the conventional individual-gamma method in terms of color error across the grayscale, except in a low grayscale range. Also, the maximum color error in the low grayscale range (0-12 gray levels) is ±0.004 compared to the existing individual-gamma method, which is not perceivable by the human eye.

Throughout the description, it should be understood for those skilled in the art that various changes and modifications are possible without departing from the technical principles of the present invention. Therefore, the technical scope of the present invention is not limited to those detailed descriptions in this document but should be defined by the scope of the appended claims.

What is claimed is:

1. A four-primary-color organic light emitting display comprising:

a display panel where a plurality of first-color pixels, second-color pixels, third-color pixels, and fourth-color pixels are disposed;

a data drive circuit that has a single, digital-to-analog converter to generate first- to fourth-color data voltages and to apply the first-color data voltage to the first-color pixels, the second-color data voltage to the second-color pixels, the third-color data voltage to the third-color pixels, and the fourth-color data voltage to the fourth-color pixels, wherein maximum grayscale voltages for the first- to fourth-color data voltages are adjusted to respective modulated maximum grayscale voltages corresponding to a single gamma graph defined as the input grayscale versus output voltage and at least one of the modulated maximum grayscale voltages is different from another one of the modulated maximum grayscale voltages; and a data modulator that receives a same number of m bits of first-color, second-color, third-color, and fourth-color digital video data (m is a natural number), which is to be displayed in each of the first- to fourth-color pixels, and that modulates the first- to fourth-color digital video data based on the modulated maximum grayscale values of the first- to fourth-color digital video data individually determined based on a luminous efficiency of each color, wherein, when the first-color pixels have a lowest luminous efficiency and the fourth-color pixels have a highest luminous efficiency, the data modulator sets a modulated maximum grayscale value of the first color at a reference value of $2^m-1$ and bypasses first-color digital video data upon receipt, and sets maximum modulated second- and third-color grayscale values to be smaller than the reference value and a modulated maximum fourth-color grayscale value to be smaller than the modulated maximum second- and third-color grayscale values, and modulates the second-color digital video data to not exceed the modulated maximum second-color grayscale value, the third-color digital video data to not exceed the modulated maximum third-color grayscale value, and the fourth-color digital video data to not exceed the modulated maximum fourth-color grayscale value.

2. The four-primary-color organic light emitting display of claim 1, wherein the maximum grayscale values of the first- to fourth-color digital video data are set in a range to reduce distortion of white color coordinates.

3. The four-primary-color organic light emitting display of claim 1, wherein one of the first- to fourth-color pixels with a lowest luminous efficiency is set to have a highest modulated maximum grayscale value, and another one of the first- to fourth-color pixels with a highest luminous efficiency is set to have a lowest modulated maximum grayscale value.

4. The four-primary-color organic light emitting display of claim 1, wherein the number of bits of the first- to third-color digital video data is maintained at m, and the number of bits of the fourth-color digital video data is modulated to be smaller than m, to set the first- to fourth-color modulated maximum grayscale values.

5. The four-primary-color organic light emitting display of claim 1, wherein the single, digital-to-analog converter comprises:

a gamma voltage generator that divides an operating voltage to generate a predetermined number of gamma voltages; and a digital-to-analog converter (DAC) switching part that maps first- to fourth-color modulated digital video data input from the data modulator to the gamma voltages input from the gamma voltage generator to generate the first- to fourth-color data voltages.

6. The four-primary-color organic light emitting display of claim 1, wherein a driving thin film transistor with a largest current driving capability corresponds to one of the first- to fourth-color pixels with a lowest luminous efficiency and another driving thin film transistor with a smallest current driving capability corresponds to another one of the first- to fourth-color pixels with a highest luminous efficiency.

7. An organic light emitting display comprising:

a display panel comprising pixels of a plurality of colors including at least a first color pixel and a second color pixel; and a data modulator that converts first-color digital video data and second-color digital video data for display on the first color pixel and the second color pixel, respectively, to modulated first-color video data and modulated second-color video data, respectively, the modulated first-color video data not exceeding a first-color maximum grayscale value and the modulated second-color video data not exceeding a second-color maximum grayscale value, the second-color maximum grayscale being smaller than the first-color maximum grayscale value, wherein the data modulator bypasses the first-color digital video data as the modulated first-color video data if the first-color digital video data does not exceed the first-color maximum grayscale value, and outputs the first-color maximum grayscale value as the modulated first-color video data if the first-color digital video data exceeds the first-color maximum grayscale value; and wherein the data modulator bypasses the second-color digital video data as the modulated second-color video data if the second-color digital video data does not exceed the second-color maximum grayscale value, and outputs the second-color maximum grayscale value as the modulated second-color video data if the second-color digital video data exceeds the second-color maximum grayscale value.

8. The organic light emitting display of claim 7, wherein the first color pixel has a first luminous efficiency and the second color pixel has a second luminous efficiency that is higher than the first luminous efficiency.

9. The organic light emitting display of claim 7, further comprising a data drive circuit that has a single, digital-to-analog converter to convert the modulated first-color video data and the modulated second-color video data to a first-color data voltage and a second-color data voltage, respectively, for display on the first color pixel and the second color pixel, respectively.

10. The organic light emitting display of claim 7, wherein both the first-color maximum grayscale value and the second-color maximum grayscale value correspond to a single gamma graph mapping gray scale values versus corresponding gamma voltages for driving the pixels of the display panel.

11. A driving method of an organic light emitting display with a display panel where a plurality of colored pixels including at least a first color pixel and a second color pixel are disposed, the method comprising:

converting, by a data modulator, first-color digital video data and second-color digital video data for display on the first color pixel and the second color pixel, respectively, to modulated first-color video data and modulated second-color video data, respectively, the modulated first-color video data not exceeding a first-color maximum grayscale value and the modulated second-color video data not exceeding a second-color maximum grayscale value, the second-color maximum grayscale being smaller than the first-color maximum grayscale value;

bypassing, by the data modulator, the first-color digital video data as the modulated first-color video data if the first-color digital video data does not exceed the first-color maximum grayscale value, and outputting the first-color maximum grayscale value as the modulated first-color video data if the first-color digital video data exceeds the first-color maximum grayscale value; and bypassing, by the data modulator, the second-color digital video data as the modulated second-color video data if the second-color digital video data does not exceed the second-color maximum grayscale value, and outputting the second-color maximum grayscale value as the modulated second-color video data if the second-color digital video data exceeds the second-color maximum grayscale value.

12. The method of claim 11, wherein the first color pixel has a first luminous efficiency and the second color pixel has a second luminous efficiency that is higher than the first luminous efficiency.

13. The method of claim 11, further comprising converting, by a data drive circuit that has a single, digital-to-analog converter, the modulated first-color video data and the modulated second-color video data to a first-color data voltage and a second-color data voltage, respectively, for display on the first color pixel and the second color pixel, respectively.

14. The method claim of 11, wherein both the first-color maximum grayscale value and the second-color maximum grayscale value correspond to a single gamma graph mapping gray scale values versus corresponding gamma voltages for driving the pixels of the display panel.

* * * * *